US005203683A

United States Patent [19]

Yoshikawa et al.

[11] Patent Number: 5,203,683

[45] Date of Patent: Apr. 20, 1993

[54] SCREW TYPE PUMP

[75] Inventors: Mamoru Yoshikawa; Taketoshi Satoh, both of Saitama, Japan

[73] Assignee: Honda Giken Kogyo Kabushiki Kaisha, Tokyo, Japan

[21] Appl. No.: 788,334

[22] Filed: Nov. 6, 1991

[30] Foreign Application Priority Data

Nov. 6, 1990 [JP] Japan ..... 2-300228

[51] Int. Cl.[5] ..... F04B 41/00

[52] U.S. Cl. ..... 417/440; 417/274; 417/278; 417/283; 418/201.2

[58] Field of Search ..... 418/201.2; 417/440, 417/274, 278, 283

[56] References Cited

U.S. PATENT DOCUMENTS 3,151,806 10/1964 Whitfield ..... 418/201.2
4,457,681 7/1984 Garland ..... 417/440
4,727,725 3/1988 Nagata et al. .
5,090,392 2/1992 Nakano et al. ..... 418/201.2

FOREIGN PATENT DOCUMENTS 53-40727 10/1978 Japan .
64-46435 3/1989 Japan .
871588 6/1961 United Kingdom .
2098662 11/1982 United Kingdom .

OTHER PUBLICATIONS

Patent Abstract of Japan Application A-57 206 789 Mar. 1983.

*Primary Examiner*—Richard A. Bertsch
*Assistant Examiner*—Charles G. Freay
*Attorney, Agent, or Firm*—Lyon & Lyon

[57] ABSTRACT

A screw pump having a pair of screw rotors meshed with each other and rotatably supported in a housing having an intake port provided at one end and a piston movably provided at the other axial end of the housing, which piston defines a discharge port in cooperation with the housing. The movement of the piston in a direction substantially perpendicular to the axes of the screw rotors enables the distance between a discharge starting position of the discharge port and the intake port to be varied, so that the internal compression ratio can be varied. This arrangement ensures that the size of the housing will not be increased and any disadvantage due to the difference in thermal expansion along the length of the housing can be overcome.

14 Claims, 10 Drawing Sheets

SCREW TYPE PUMP

BACKGROUND OF THE INVENTION

1. Field of the Invention

The field of the present invention is screw type pumps, such as mechanical superchargers, having a pair of screw rotors meshed with each other and rotatably supported in a housing, and particularly, screw type pumps with a variable internal compression ratio.

2. Description of the Prior Art

Screw type pumps with a variable internal compression ratio are already known, for example, from Japanese Utility Model Application Laid-open No. 46435/89 and Japanese Utility Model Publication No. 40727/78.

In a mechanical supercharger in the form of a screw type pump that is disclosed in Japanese Utility Model Application Laid-open No.46435/89, a slide valve movable axially of the screw rotors is provided in the housing, so that the internal compression ratio is varied by driving the slide valve. Because the slide valve is moved axially, however, the size of the housing is increased by the range of such movement. Moreover, in a mechanical supercharger using screw rotors, the temperature varies in the axial direction of the supercharger. Therefore, in a structure in which the slide valve is moved in the axial direction, a difference in clearance between the slide valve and the housing is produced in such axial direction due to a difference in thermal expansion depending upon the variation of temperature, thereby making reliable sealing difficult.

In a supercharger in the form of the screw type pump disclosed in the above-identified Japanese Utility Model Publication No.40727/78, a portion of the intake gas is circulated by controlling an opening provided in the side of a housing for opening and closing thereof and therefore, a reduction in efficiency occurs.

SUMMARY OF THE INVENTION

Accordingly, it is an object of the present invention to provide a screw type pump wherein the above problem can be solved by a simplified structure and the internal compression ratio can be varied.

To achieve the above object, according to a first aspect of the present invention, there is provided a screw type pump having a pair of screw rotors meshed with each other and rotatably supported in a housing, comprising a piston provided on a side of the housing having an intake port provided at one axial end for movement between a high-compression position inwardly in the moving direction perpendicular to the axis of the screw rotors and a low-compression position outwardly in the moving direction, the piston defining a discharge port in cooperation with a lead-out section provided at the other axial end of the housing, that portion of the piston which faces into the housing being formed so that a discharge starting position of the discharge port at the time when the piston is in the low-compression position is closer to the intake port than a discharge starting position of the discharge port at the time when the piston is in the high-compression position.

With the construction of the above first feature, when the piston is brought into the high-compression position, the distance from the intake port to the discharge starting position of the discharge port is increased to provide a high internal compression ratio. On the other hand, when the piston is brought into the low-compression position, the distance from the intake port to such discharge starting position is decreased to provide a low internal compression ratio. Moreover, the piston is movable in the moving direction substantially perpendicular to the axes of the screw rotors and therefore, an increase in the size of the housing is avoided and a disadvantage due to a difference in thermal expansion is overcome. In addition, because a gas is not circulated, a reduction in efficiency of operation is also avoided.

In addition to the first feature, it is a second feature of the present invention that a back pressure chamber is defined, to which a back of the piston faces, and a communication hole is provided in the piston for permitting the communication of the back pressure chamber with the discharge port. With the construction of the second feature, an equal pressure can be applied to opposite surfaces of the piston, thereby stably maintaining the position of the piston and suppressing the required piston driving force to a small level.

Further, in addition to the first and second features, it is a third feature of the present invention that a drive member displaceable in the moving direction and biased by a spring outwardly in the moving direction is connected to the piston, and a switchover valve is connected to a control chamber defined with an outer portion of the drive member in the moving direction facing to the control chamber and is capable of permitting a discharge pressure from the discharge port or the atmospheric pressure to be introduced into the control chamber in a switched manner. With the construction of the third feature, the operation of the piston to the high-compression position in accordance with the pressure from the discharge port ensures that the position of the piston in the high-compression state can be stabilized, thereby providing an improvement in efficiency.

The above and other objects, features and advantages of the invention will become apparent from reading of the following description of the preferred embodiments, taken in conjunction with the accompanying drawings.

BRIEF DESCRIPTION OF THE DRAWINGS

FIGS. 1 to 7 illustrate a preferred embodiment of the present invention, wherein FIG. 1 is a diagram of an entire system for using the screw type pump of this invention on an internal combustion engine;

FIG. 2 is a partially cutaway longitudinal sectional side view of a screw type pump supercharger of this invention;

FIG. 3 is a sectional view taken along a line III—III in FIG. 2;

FIG. 4 is a sectional view taken along a line IV—IV in FIG. 2;

FIG. 5, comprised of FIGS. 5A and 5B, is a flow chart illustrating a procedure for controlling the compression ratio of the supercharger;

FIG. 6 is a diagram illustrating a control region associated with the engine revolution rate and the throttle opening degree;

FIG. 7 is a diagram illustrating a supercharge pressure introducing region and an atmospheric pressure introducing region associated with the engine revolution rate and the supercharge pressure; and FIGS. 8 and 9 illustrate a modification of the piston for the screw type pump supercharger, wherein FIG. 8 is a partially cutaway longitudinal sectional side view of a supercharger similar to FIG. 2; and FIG. 9 is a sectional view taken along a line IX—IX in FIG. 8.

DESCRIPTION OF THE PREFERRED EMBODIMENTS

The present invention will now be described by way of a preferred embodiment in connection with the accompanying drawings.

Figure 1:
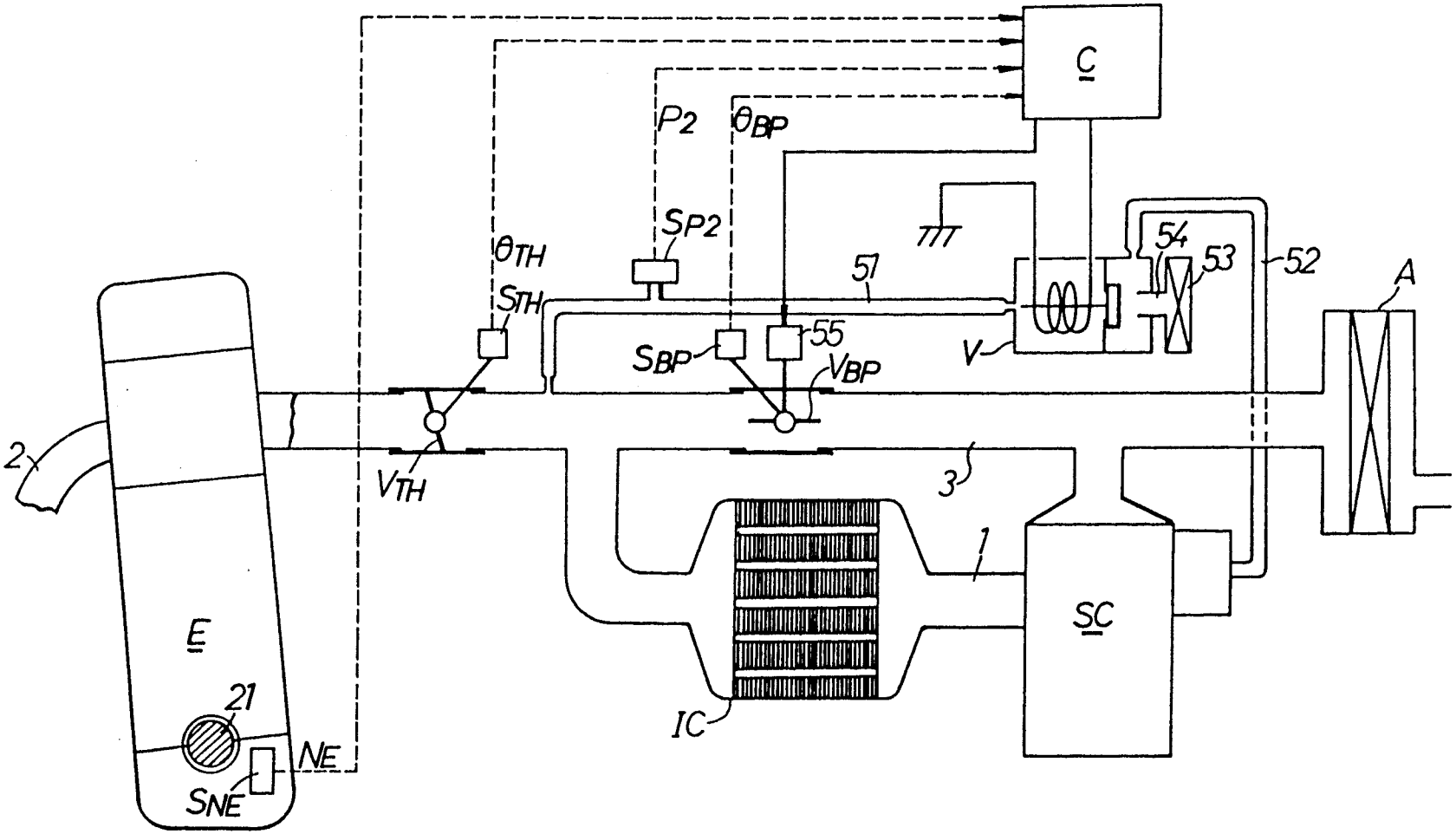

Referring first to FIG. 1, an intake passage 1 and an exhaust passage 2 are connected to an internal combustion engine E, and an air cleaner A is connected to an upstream end of the intake passage 1. A mechanical supercharger SC, which is a screw type pump, an intercooler IC and a throttle valve $V_{TH}$ are provided in the middle of the intake passage 1 in sequence from its upstream end. A bypass passage 3 for detouring around the mechanical supercharger SC and the intercooler IC is connected to the intake passage 1. A bypass valve $V_{EP}$ is provided in the bypass passage 3.

Figure 2:
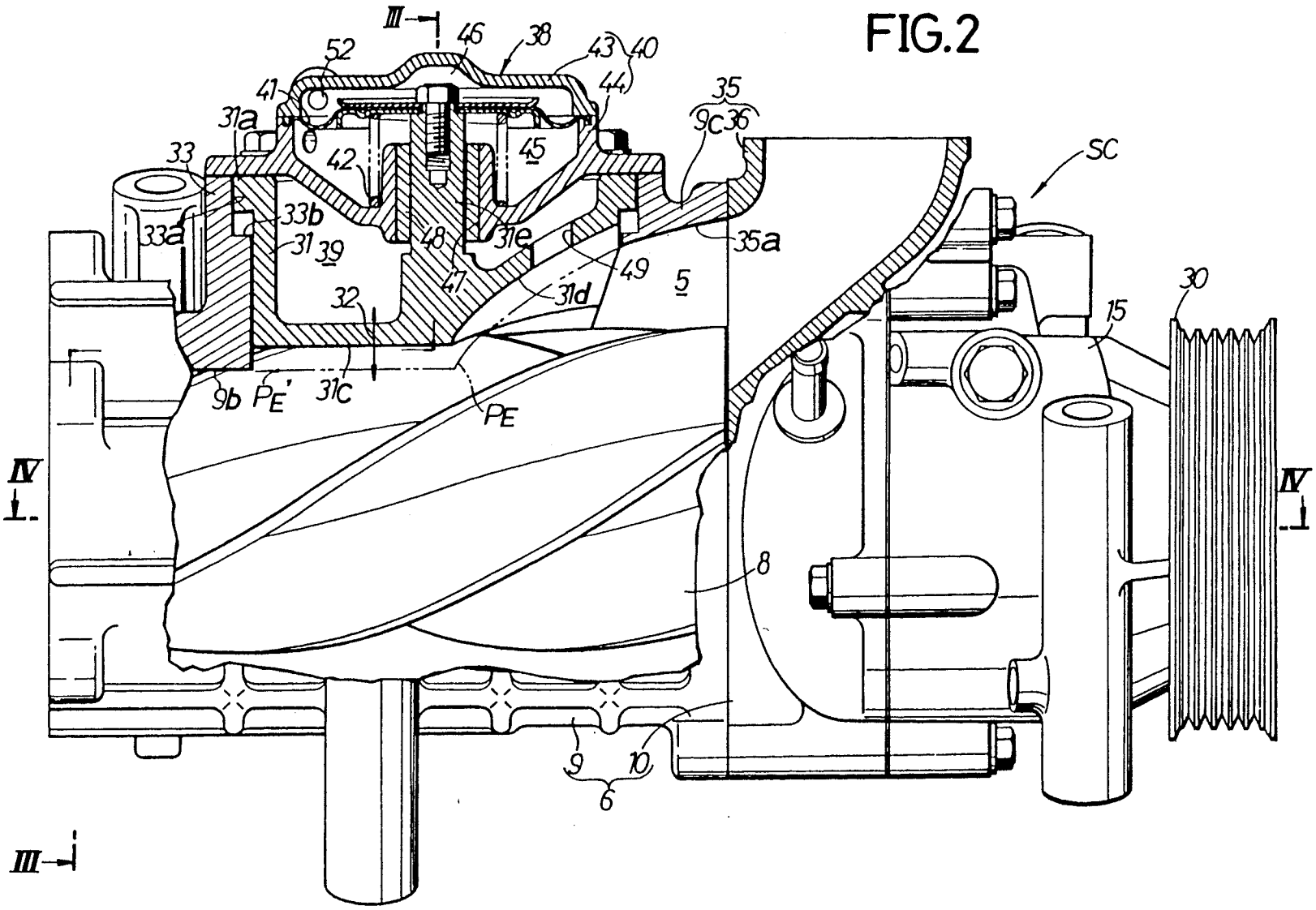
Figure 3:
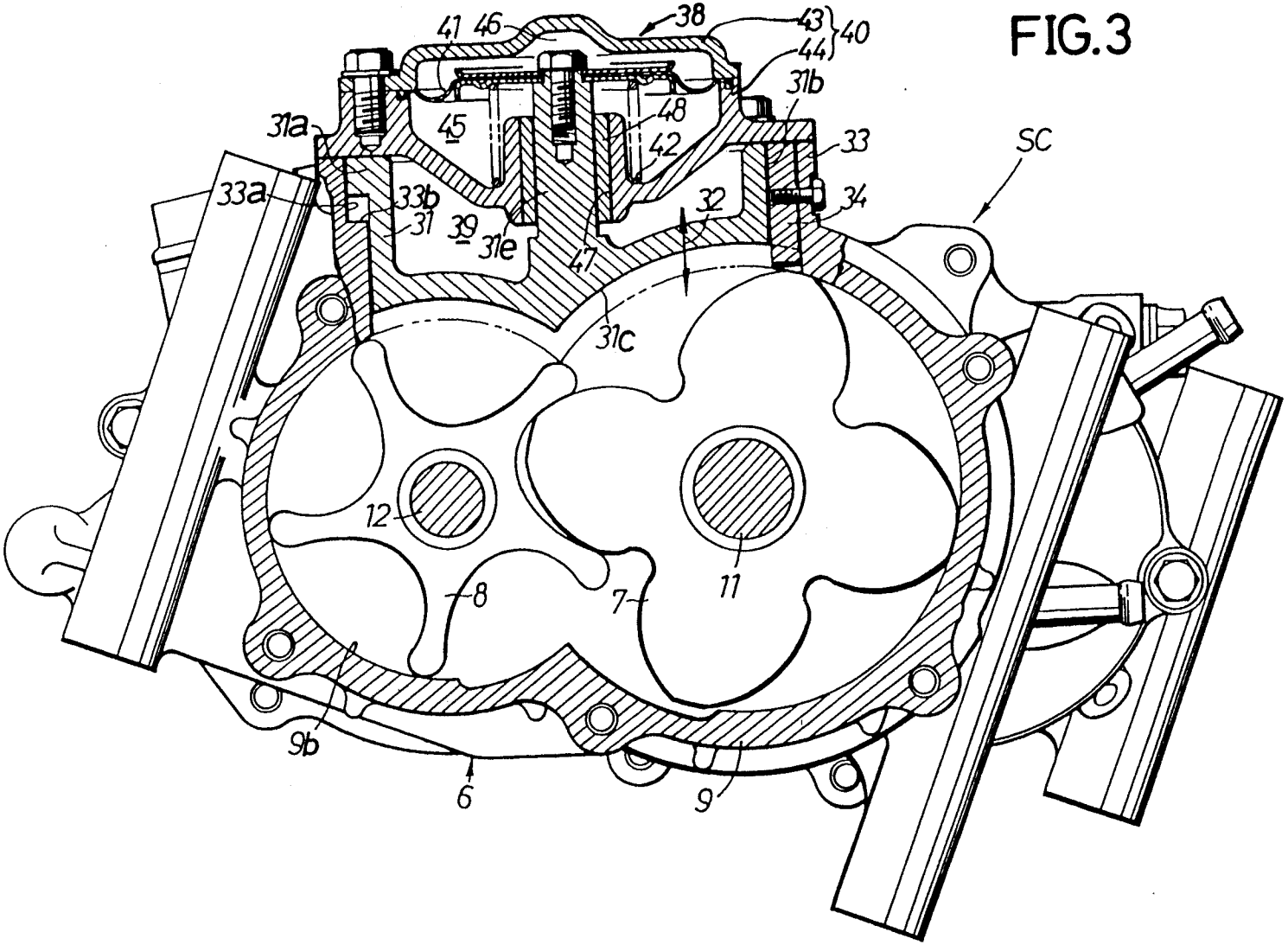
Figure 4:
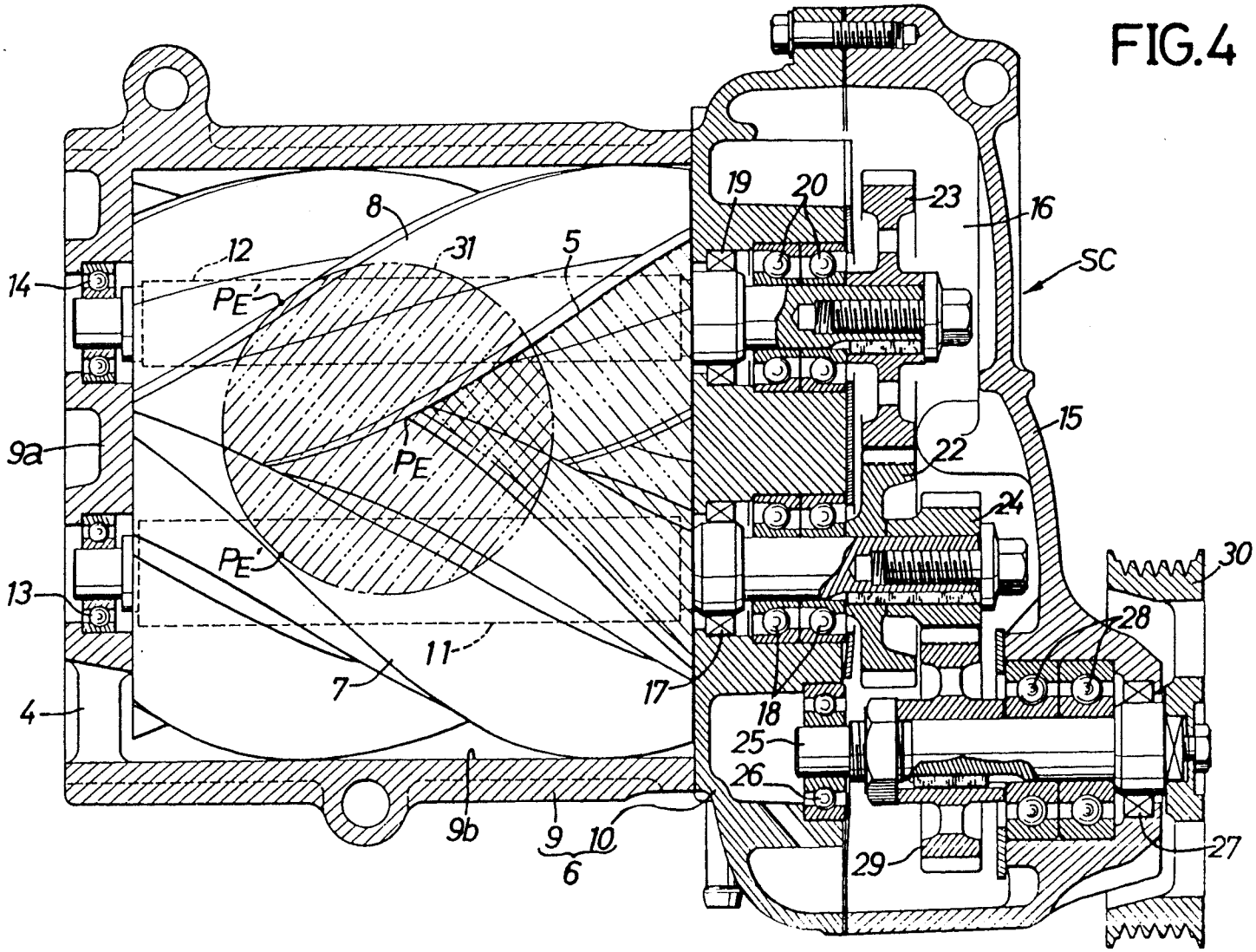

Referring to FIGS. 2, 3 and 4, the mechanical supercharger SC is comprised of a main rotor 7 and a gate rotor 8 which are a pair of screw rotors meshed with each other and rotatably supported in a housing 6. Air is drawn through an intake port 4 provided in one axial end of the housing 6 and is discharged through a discharge port 5 provided in the other axial end by the rotors 7 and 8 which are mechanically rotated by the engine E.

The housing 6 is comprised of a cylindrical member 9 formed into a bottomed cylindrical shape with one end closed by an end wall 9*a*, and an end wall member 10 coupled to the other end of the cylindrical member 9 to cover that open end. The cylindrical member 9 is formed to have a cross-sectional shape corresponding to a rotational locus described by the radially outer end of each of the rotors 7 and 8 and has an inner surface 9*b* which does not come into contact with the rotors 7 and 8. The intake port 4 is provided in the end wall 9*a*.

The rotors 7 and 8 are secured to rotary shafts 11 and 12, respectively, which are carried at one end on the end wall 9*a* of the cylindrical member 9 by bearings 13 and 14 interposed therebetween, respectively. A cover 15 is coupled to the end wall member 10 to define a gear chamber 16 between the cover 15 itself and the end wall member 10. The other ends of the rotary shafts 11 and 12 are passed through the end wall member 10 to project into the gear chamber 16. A sealing member 17 and a pair of bearings 18 are interposed between the rotary shaft 11 and the end wall member 10, and a sealing member 19 and a pair of bearings 20 are interposed between the rotary shaft 12 and the end wall member 10.

Gears 22 and 23 which are meshed with each other are fixed to the rotary shafts 11 and 12, respectively, within the gear chamber 16 and in addition to the gear 22, a gear 24 is fixed to the rotary shaft 11. A shaft 25 is rotatably supported at one end on the end wall member 10 with a bearing 26 interposed therebetween and has an axis parallel to the rotary shafts 11 and 12. The shaft 25 extends through the cover 15 to project outwardly. A sealing member 27 and a pair-of bearings 28 are interposed between the shaft 25 and the cover 15. A gear 29 which is meshed with the gear 24 is fixed to the shaft 25 Within the gear chamber 16, and a pulley 30 is fixed to an outer end of the shaft 25 which projects from the cover 15. Power from a crankshaft 21 (see FIG. 1) of the engine E is transmitted to the pulley 30 through an endless belt which is not shown, thereby causing the main rotor 7 and the gate rotor 8 to be meshed with each other for rotation.

A piston 31 is disposed on a side of the cylindrical portion 9 in the housing 6 at a location corresponding to meshed portions of the main rotor 7 and the gate rotor 8 for movement between a high-compression position (a position shown by dashed lines in FIGS. 2 and 3) inwardly in a moving direction 32 substantially perpendicular to the axes of the screw rotors 7 and 8 and a low-compression position (a position shown by solid lines FIGS. 2 and 3) outwardly in the moving direction 32. More specifically, the cylindrical member 9 is integrally provided at its side with a cylindrical guide portion 33 having a circular cross-section and extending in a direction perpendicular to the axes of the rotors 7 and 8, and the piston 31 is disposed within the cylindrical guide portion 33 for movement in the moving direction 32. The piston 31 is formed into a circular shape in cross section with the outside diameter thereof smaller than the inside diameter of the cylindrical guide portion 33 and is not supported by the cylindrical guide portion 33.

The piston 31 is formed into a bottomed cylindrical shape with a closed end thereof directed into the housing 6 and provided at its opened end, i.e., at its outer end with a collar 31*a* projecting radially outwardly. A large diameter portion 33*a* is provided through an outwardly facing step 33*b* on an inner surface of the cylindrical guide portion 33 at a location close to the axially outer end thereof to receive the collar 31*a* and the extreme axial positions of the piston 31 are defined by a case 40 coupled to an outer end of the cylindrical guide portion 33 and by the step 33*b*. An axially extending key 34 is secured at one place in the inner surface of the cylindrical guide portion 33, and the collar 31*a* of the piston 31 is provided with a notch 31*b* into which the key 34 is fitted. Thus, the piston 31 is prevented by the key 34 from being rotated about its axis and is movable for a limited distance in the moving direction 32.

The discharge port 5 is defined by cooperation of the piston 31 with a lead-out section 35 provided at an axial end of the housing 6 at a location corresponding to the meshed portions of the main rotor 7 and the gate rotor 8. The lead-out section 35 is comprised of a protrusion 9*c* provided at the open end of the cylindrical member 9 of the housing 6 to protrude outwardly from an inner surface 9*b*, and a lead-out tube 36 provided on the end wall member 10. The portion of the piston 31 which faces into the housing 6 is formed in such a manner that the distance from the intake port 4 to a discharge starting position $P_E$ of the discharge port 5 at the time when the piston 31 is in inward or high-compression position is larger than the distance from the intake port 4 to discharge starting positions $P_E'$ and $P_E'$ at the time when the piston 31 is in the outward or low-compression position. The piston 31 is provided, at the portion facing into the housing 6, with a surface 31*c* smoothly connected to the inner surface of the housing 6 and a surface 31*d* smoothly connected to an inner surface 35*a* of the lead-out section 35 when the piston 31 is in the high-compression position. Thus, when the piston 31 is in the high-compression position, a portion shown by the oblique dashed lines inclined downwardly to the right in FIG. 4 serves as the discharge port 5, and the junction between the surfaces 31*c* and 31*d* is the discharge starting position $P_E$. When the piston 31 is in the low-compression position, a portion shown by the oblique dashed lines inclined both downwardly to the left and to the right in FIG. 4 serves as the discharge port 5 by the fact that the surface 31c is located more outwardly than the inner surface 9b of the housing 6, and the two positions in which grooves in the rotors 7 and 8 first communicate with the discharge port 5 in response to the rotation of the rotors 7 and 8 are the discharge starting positions $P_E'$ and $P_E'$. Thus, when the piston 31 is in the low-compression position and the discharge starting positions $P_E'$ and $P_E'$ are close to the intake port 4, an internal compression ratio $\epsilon$ is of 1.0. When the piston 3 is in the high-compression position and the discharge starting position $P_E$ is spaced apart from the intake port 4, the internal compression ratio $\epsilon$ is, for example, 1.3.

A drive means 38 is connected to the piston 31 and comprises the case 40 coupled to the outer end of the cylindrical guide portion 33 to define a back pressure chamber 39 between the case 40 itself and the piston 31, a diaphragm 41 as a driving member housed in the case 40 and clamped at its peripheral edge by the case 40, and a spring 42 mounted in a compressed manner between the diaphragm 41 and the case 40. The case 40 is comprised of a pair of case members 43 and 44 coupled to each other, and the peripheral edge of the diaphragm 41 is clamped between both the case members 43 and 44. The interior of the case 40 is divided by the diaphragm 41 into an atmospheric pressure chamber 45 inwardly in the moving direction 32 of the piston 31 and a control chamber 46 outwardly in the moving direction 32. The spring 42 is received in the atmospheric pressure chamber 45 to produce a spring force for biasing the diaphragm 41 in a direction to reduce the volume of the control chamber 46. A through hole 47 is provided at the central portion of the case member 44 which partitions the back pressure chamber 39 and the atmospheric pressure chamber 45 in the case 40, and a cylindrical bearing sleeve 48 is fitted and fixed in the through hole 47. The piston 31 is integrally provided with a connecting rod 31e extending in the moving direction 32. The bearing sleeve 48 is connected to a central portion of the diaphragm 41 and slidably supports the connecting rod 31c.

In this way, the piston 31 is not supported by the cylindrical guide portion 33 but rather is supported on the drive means 38 through the connecting rod 31e. This ensures that the sliding-contact area of the piston 31 at the time when it is moved in the moving direction 32 can be reduced to minimize the friction loss and to prevent a sticking of the piston 31 within the cylindrical guide portion 33 due to a deformation of the piston 31 by thermal influence because the piston 31 is close to the discharge port 4 which has a relatively high temperature.

Such drive means 38 allows the piston 31 to be moved inwardly to the high-compression position against the spring force of the spring 42 by increasing the pressure in the control chamber 46, and allows the piston 31 to be moved outwardly to the low-compression position by the spring force of the spring 42 when the pressure in the control chamber 46 is reduced.

The piston 31 is also provided with a communication hole 49 for putting the back pressure chamber 39 into communication with the discharge port 5, so that the pressure in the back pressure chamber 39 is equal to the discharging pressure in the discharge port 5.

Referring again to FIG. 1, a conduit 51 is diverged from the intake passage 1 at a location corresponding to the point of where the bypass passage 3 joins passage 1 downstream of the intercooler IC. A conduit 52 is connected to the control chamber 46 in the drive means 38. A switchover valve V is provided between a passage 54 opened into the atmosphere through an air cleaner 53 and the conduits 51 and 52 and is capable of alternatively switching-over the connection and disconnection of the passage 54 and the conduits 51 and 52. The switchover valve V is a solenoid valve which is capable of being shifted between a state in which the passage 54 is put into communication with the conduit 52 upon energization thereof, i.e., a state in which the atmospheric pressure is introduced into the control chamber 46, and a state in which the conduit 51 is put into communication with the conduit 52 upon deenergization thereof, i.e., a state in which a discharging pressure $P_2$ is introduced into the control chamber 46.

The shifting operation of the switchover valve V and the operation of a bypass valve driving means 55 for driving a bypass valve $V_{EP}$ for opening and closing are controlled by a control means C including a microcomputer. The control means C controls the operations of the switchover valve V and the bypass valve driving means 55 in accordance with the throttle opening degree $\theta_{TH}$ of the throttle valve $V_{TM}$, the engine revolution rate $N_E$, the bypass opening degree $\theta_{EP}$ of the bypass valve $V_{EP}$ and the supercharge pressure $P_2$. Signals are supplied to the control means C from a revolution rate detecting sensor $S_{NE}$ for detecting the engine revolution rate $N_E$, a throttle opening degree detecting sensor $S_{TH}$ for detecting the throttle opening degree $\theta_{TH}$ and a supercharge pressure detecting sensor $S_{P2}$ located in the middle of the conduit 51.

The control of the supercharge pressure $P_2$ is effected through the bypass valve $V_{EP}$. The control means C produces a feed-back control for the bypass valve $V_{EP}$ in a feed-back control region in which the engine revolution rate $N_E$ is relatively low and the throttle opening degree $\theta_{TH}$ is relatively large. The control means C produces an open control for the bypass valve $V_{EP}$ with a target opening degree determined in an open control region in which the engine revolution rate $N_E$ is relatively high and the throttle opening degree $\theta_{TH}$ is relatively small. With the opening degree of the bypass valve $V_{EP}$ determined in such manner, the control means C controls the compression ratio of the supercharger SC according to a control procedure shown in FIGS. 5A and 5B.

Figure 5A:
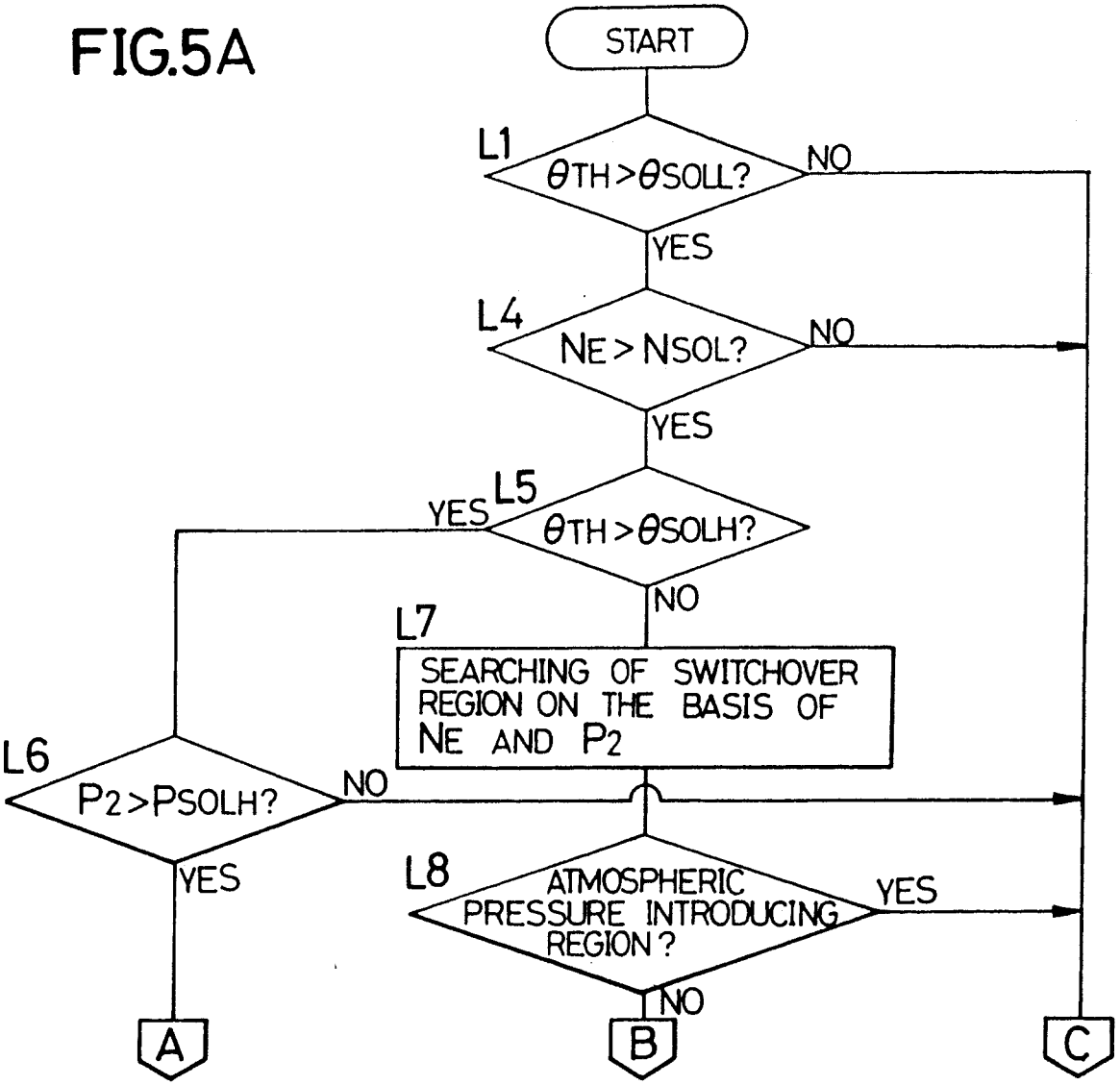
Figure 5B:
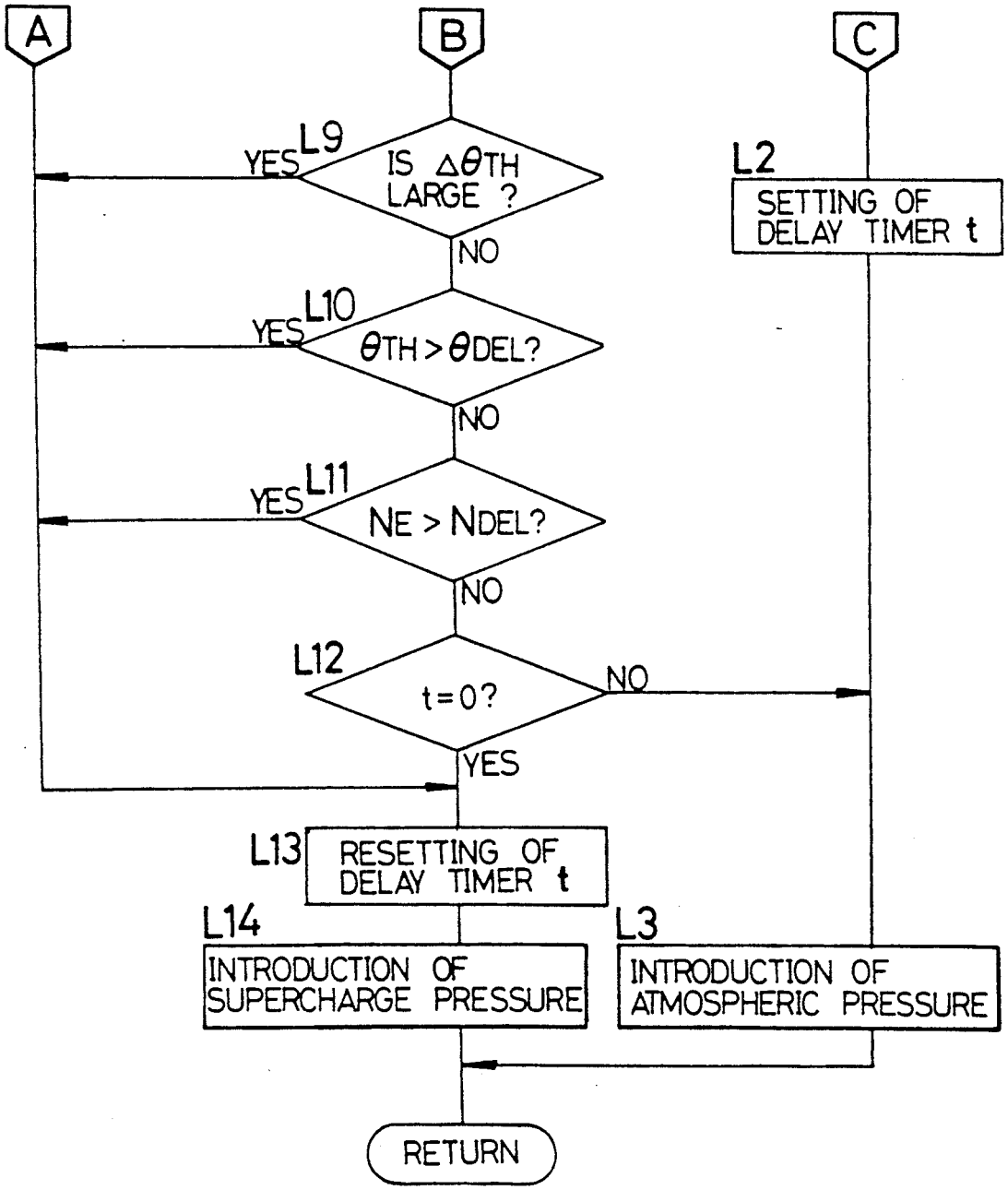

Referring to FIGS. 5A and 5B, it is decided at a first step L1 whether or not the throttle opening degree $\theta_{TH}$ exceeds a predetermined preset throttle opening degree $\theta_{SOLL}$ ($\theta_{TH} > \theta_{SOLL}$). The preset throttle opening degree $\theta_{SOLL}$ is used as a judging criterion for forceably reducing the internal compression ratio of the supercharger SC on the basis of the fact that, when the throttle opening degree $\theta_{TH}$ is small, it is not required to increase the internal compression ratio and the supercharge pressure $P_2$ remains small, because the bypass valve $V_{EP}$ is open. The preset throttle opening degree $\theta_{SOLL}$ is set, for example, at 15/10 degrees to have a hysterisis. When $\theta_{TH} \leqq \theta_{SOLL}$, the processing is advanced to a second step L2 at which the countdown of a delay timer t which is set, for example, at 3 seconds is started. At a next third step L3, the switchover valve V is energized to permit the atmospheric pressure to be introduced into the control chamber 46.

If it has been decided at the first step L1 that $\theta_{TH} > \theta_{SOLL}$, the processing is advanced to a fourth step L4 at which it is decided whether or not the engine revolution rate $N_E$ exceeds a preset revolution rate $N_{SOL}$ ($N_E > N_{SOL}$). The preset revolution rate $N_{SOL}$ is used as a judging criterion for forceably reducing the internal compression ratio of the supercharger SC, because an increase in supercharge pressure $P_2$ cannot be expected in a condition in which the engine revolution rate $N_E$ is low. The preset revolution rate $N_{SOL}$ is set, for example, at 1,200/1,000 rpm to have a hysterisis. If it has been decided that $N_E \leqq N_{SOL}$, the processing is advanced to the second step L2. On the other hand, if it has been that $N_E > N_{SOL}$, the processing is advanced to a fifth step L5.

At the fifth step L5 it is decided whether or not the throttle opening degree $\theta_{TH}$ exceeds a predetermined preset throttle opening degree $\theta_{SOLH}$ ($\theta_{TH} > \theta_{SOLH}$). The preset throttle opening degree $\theta_{SOLH}$ is used to judge whether or not a vehicle driver desires to accelerate. The preset throttle opening degree $\theta_{SOLH}$ is set, for example, at 60/50 degree to have a hysterisis. If it has been decided that $\theta_{TH} > \theta_{SOLH}$, the processing is advanced to a sixth step L6 on the basis of the decision that the driver desires to accelerate. At the sixth step L6, it is decided whether or not the supercharge pressure $P_2$ exceeds preset supercharge pressure $P_{SOLH}$ ($P_2 > P_{SOLH}$). The preset supercharge pressure $P_{SOLH}$ is used to avoid noise that normally is produced due to a pulsing when the internal compression ratio of the supercharger SC is increased in a condition in which a sufficient supercharge pressure $P_2$ cannot be obtained, even if the driver desires to accelerate. The preset supercharge pressure $P_{SOLH}$ is set, for example, at 300 mm Hg. If it has been decided that $P_2 \leqq P_{SOLH}$, the processing is advanced to the second step L2, and if $P_2 > P_{SOLH}$, the processing is advanced to a thirteenth step L13.

If it has been decided at the fifth step L5 that $\theta_{TH} \leqq \theta_{SOLH}$, the processing is advanced to a seventh step L7 at which a searching of a switchover region on the basis of the engine revolution rate $N_E$ and the supercharge pressure $P_2$ is carried out. Specifically, the processing is advanced to the seventh step L7 on condition that the engine revolution rate $N_E$ and the throttle opening degree $\theta_{TH}$ are within a range shown by an oblique line inclined downwardly to the left in FIG. 6 on the basis of the decisions up to the fifth step L5, and at the seventh step L7, it is searched from a map established as shown in FIG. 7 whether either the atmospheric pressure or the supercharge pressure $P_2$ is to be introduced into the control chamber 46 in the drive means 38 within such range. A boundary value between an atmospheric pressure introducing region and a supercharge pressure introducing region has a hysterisis, and the supercharger SC in its high-compression state produces the larger supercharge pressure as the engine revolution rate $N_E$ is higher. Therefore, the boundary value is set such that the supercharge pressure introducing region is defined to introduce a larger supercharge pressure as the engine revolution rate $N_E$ is larger.

If it has been decided at an eighth step L8 that the engine revolution rate $N_E$ and the supercharge pressure $P_2$ are in the atmospheric pressure introducing region, the processing is advanced to the second step L2. On the other hand, if it has been decided that the engine revolution rate $N_E$ and the supercharge pressure $P_2$ are in the supercharge introducing region, the processing is advanced to a ninth step L9.

At the ninth step L9, it is decided whether the variation rate $\Delta\theta_{TH}$ in throttle opening degree $\theta_{TH}$ is larger than a predetermined value. If it has been decided that the variation rate $\Delta\theta_{TH}$ is larger than the predetermined value, the processing is advanced to the thirteenth step L13 on the basis of the decision that there is a need to increase the speed of the vehicle. If it has been decided that the variation rate $\Delta\theta_{TH}$ is smaller than the predetermined value, the processing is advanced to a tenth step L10. It is decided at the tenth step L10 whether the throttle opening degree $\theta_{TH}$ exceeds a preset throttle opening degree $\theta_{DEL}$, e.g., 40 degree ($\theta_{TH} > \theta_{DEL}$). If it has been decided that $\theta_{TH} > \theta_{DEL}$, the processing is advanced to the thirteenth step L13, while if it has been decided that $\theta_{TH} \leqq \theta_{DEL}$, the processing is advanced to an eleventh step L11. Further, it is decided at the eleventh step L11 whether or not the engine revolution rate $N_E$ exceeds a preset rotational rate $N_{DEL}$, e.g., 5,000 rpm ($N_E > N_{DEL}$). If it has been decided that $N_E \leqq N_{DEL}$, the processing is advanced to the thirteenth step L13, while if it has been decided that $N_E \leqq N_{DEL}$, the processing is advanced to a twelfth step L12.

At the twelfth step L12, it is decided whether or not the delay timer t has reached "O" i.e., a predetermined time has elapsed after the start of counting-down of the delay timer t at the second step L2. If it has been decided that "O" has not been reached, the processing is advanced to the third step L3, while if it has been decided that the predetermined time has elapsed and thus, "O" has been reached, the processing is advanced to the thirteenth step L13.

At the thirteenth step L13, the delay timer t is reset when the processing is advanced thereto from any of the sixth, ninth, tenth or eleventh steps L6, L9, L10 and L11. At a next fourteenth step L14, the switchover valve V is operated to permit the supercharge pressure $P_2$ to be introduced into the control chamber 46.

Figure 6:
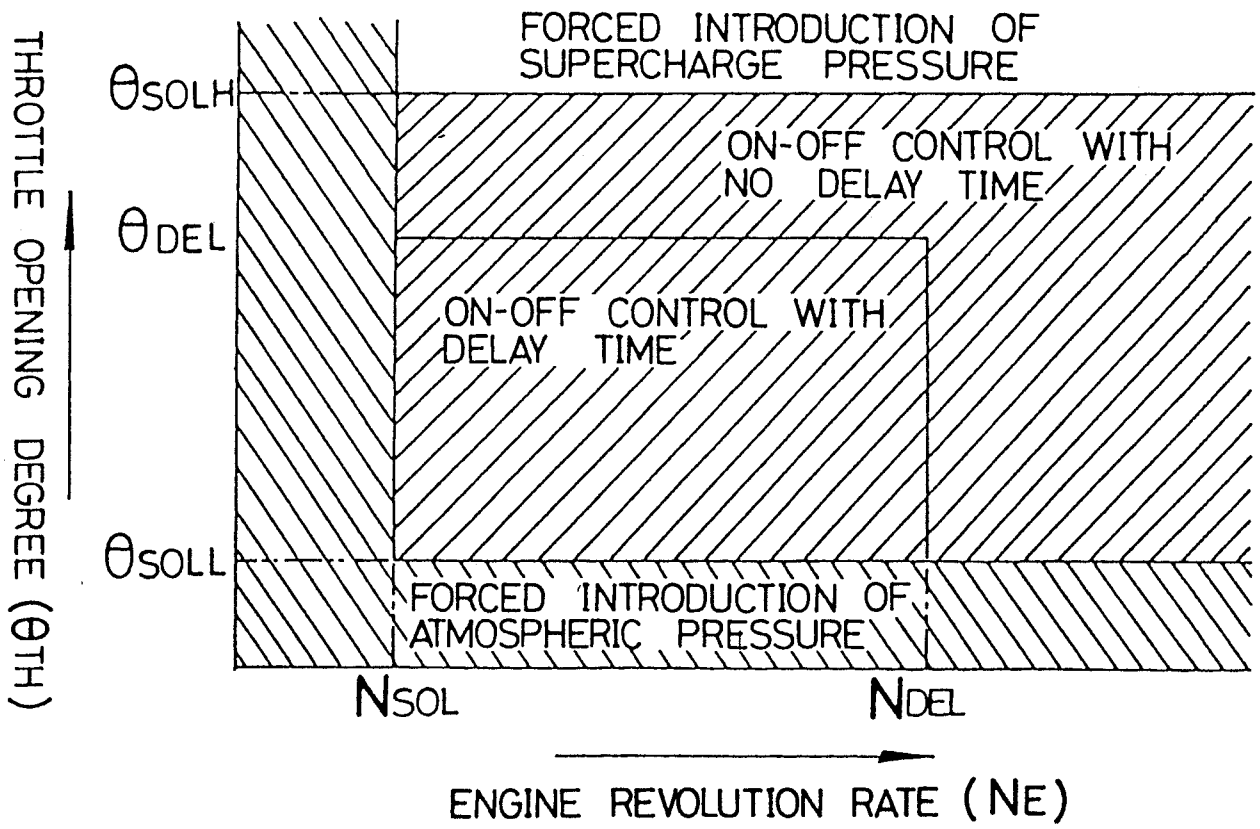
Figure 7:
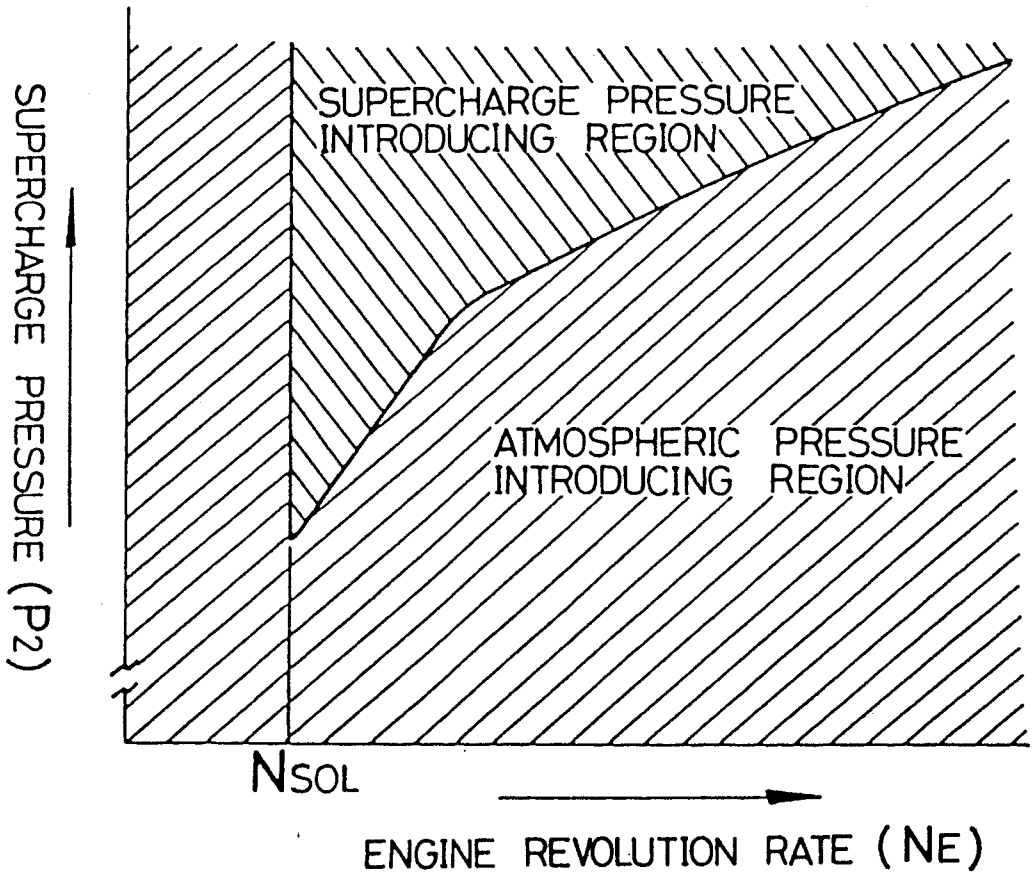

Such control procedure shown in FIG. 5 ensures that as shown in FIG. 6, the operation of the switchover valve in is controlled in accordance with the engine revolution rate $N_E$ and the throttle opening degree $\theta_{TH}$, so that the switchover valve V is shifted between the state in which the atmospheric pressure is introduced into the control chamber 46 to provide the compression ratio $\epsilon$ of 1.0 and the state in which the supercharge pressure $P_2$ is introduced into the control chamber 46 to provide the compression ratio $\epsilon$ of 1.3. Moreover, in a region in which $\theta_{SOLL} < \theta_{TH} \leqq \theta_{SOLH}$ and $N_E > N_{SOL}$, the operation of the switchover valve V is controlled in a shifted manner according to the map shown in FIG. 7, but even within such region and particularly in a region in which $\theta_{TH} \leqq \theta_{DEL}$ and $N_E \leqq N_{DEL}$, the shift of the switchover valve V to the state in which the supercharge pressure $P_2$ is introduced into the control chamber 46 to provide the compression ratio of the supercharger SC of 1.3, is avoided unless the state permitting the compression ratio to become 1.3 is maintained for a predetermined time, e.g., for at least 3 seconds.

The operation of this embodiment now will be described. In a condition in which the atmospheric pressure has been introduced into the control chamber 46 in the drive means 38 through the switchover valve V, the piston 31 is in the low-compression position, and the discharge starting positions $P_E'$ and $P_E'$ are close to the intake port 4, thereby permitting the compression ratio $\epsilon$ to become 1.0. If the switchover valve V in is shifted to the state in which the supercharge pressure $P_2$ is introduced into the control chamber 46, the piston 31 is brought into the high-compression position, and the discharge starting position $P_E$ is spaced further away from the intake port 4, permitting the internal compression ratio to become 1.3.

In this supercharger SC, the piston 31 is movable in the moving direction substantially perpendicular to the axes of the main rotor 7 and the gate rotor 8 and hence, an increase in size of the housing 6 is avoided, ensuring that even if a distribution of temperature in an axial direction of the housing is produced, there is no disadvantage due to a difference in thermal expansion amount. In addition; a gas is not circulated and hence, a reduction in efficiency of operation is avoided.

Further, the provision of the communication hole 49 in the piston 31 for permitting the communication of the discharge port 5 with the back pressure chamber 39 ensures that an equal pressure can be applied to the opposite surfaces of the piston 31 to stably maintain the position of the piston 31, and the operation power required to move the piston 31 during shifting can be reduced.

Moreover, in the drive means 38, the piston 31 is brought into the high-compression position by a pressure discharged from the supercharge SC and therefore, a dynamic pressure in the supercharger SC that would cause the position of the piston 31 to be unstable is avoided, thereby preventing a reduction in efficiency due to the position of the piston 31 being unstable. To the contrary, if the piston 31 were brought into the high-compression position by the spring force of the spring 42, the position of the piston 31 would be unstable due to the dynamic pressure in the high-compression state.

The shifting operation of the switchover valve V, i.e., the switching-over of the internal compression ratio of the supercharger SC, is controlled in accordance with the supercharge pressure $P_2$ and the engine revolution rate $N_E$ and therefore, pulsing due to a difference between the pressure in the supercharger SC and the supercharge pressure $P_2$ according to the engine revolution rate $N_E$ is avoided, thereby preventing a noise from being produced due to the pulsing.

In switchover from the low-compression state to the high-compression state, the bypass valve $V_{EP}$ is closed and hence, it is difficult for any noise produced on the discharge side of the supercharger SC to leak through the air cleaner A to the outside. Therefore, even if the switchover is delayed somewhat, the noise cannot leak out. In addition, the frequency of operation of the piston 31 can be suppressed to a small extent, leading to an improved durability, because the low-compression state cannot be switched over to the high-compression state unless the predetermined time, e.g., at least 3 seconds has elapsed. Moreover, if the driver has a strong desire to accelerate, i.e., if $\Delta\theta_{TH}$ is equal to or more than the predetermined value, $\theta_{TH}>\theta_{DEL}$ and $N_E>N_{DEL}$, the low-compression state is immediately switched over to the high-compression state and hence, there is no problem in the response time.

Because the bypass valve $V_{EP}$ is opened in switching-over from the high-compression state to the low-compression state, any noise can be prevented from being leaked to the outside by conducting the switching-over without a delay.

Further, because a reference value of the supercharge pressure $P_2$ for switching-over from the low-compression state to the high-compression state is set such that it is larger as the engine revolution rate $N_E$ is larger, it is possible to switch over the internal compression ratio $\epsilon$ to a value appropriately corresponding to the supercharge pressure $P_2$, leading to an improvement in efficiency.

Figure 8:
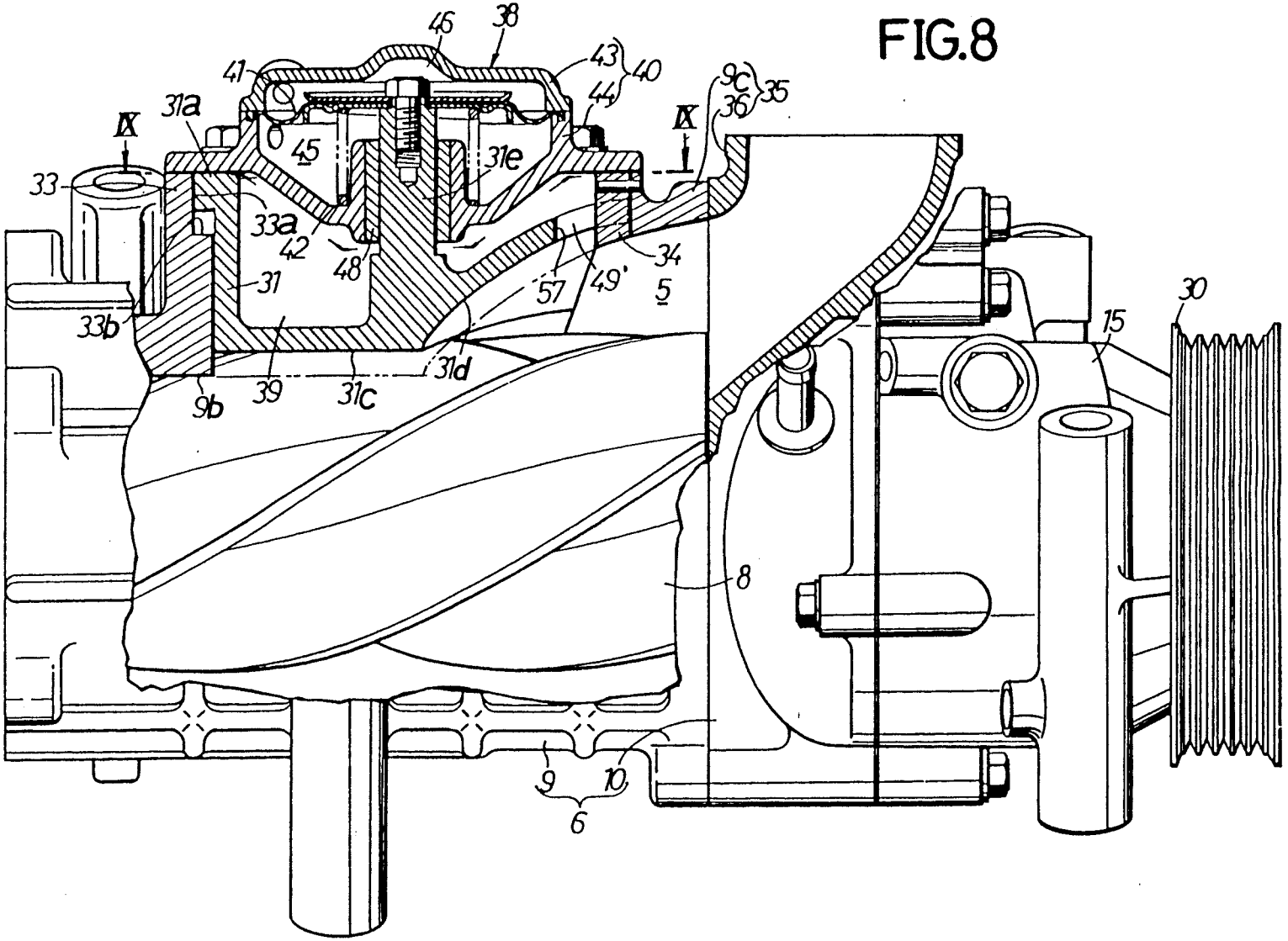
Figure 9:
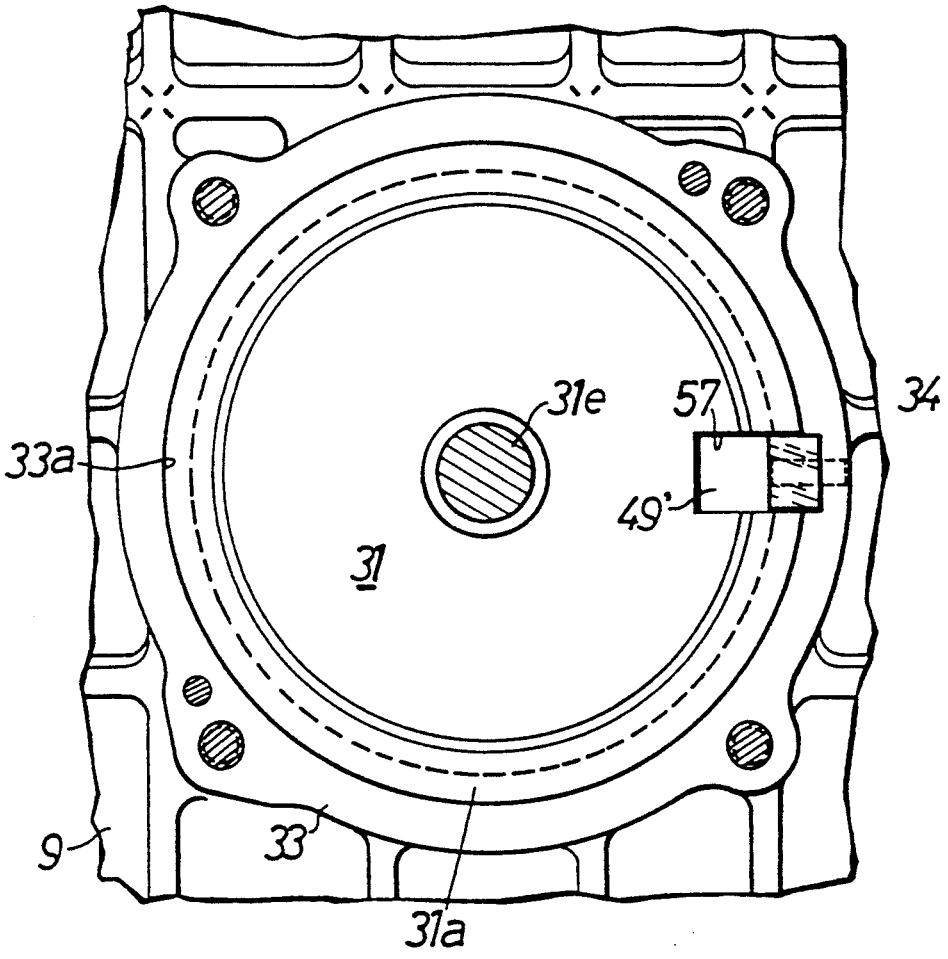

A modification of the piston now will be described with reference to FIGS. 8 and 9, wherein parts or components corresponding to those in the above-described embodiment are indicated by the same reference characters. A key 34 is secured in the cylindrical guide portion 33 in the cylindrical member 9 of the housing 6 at one place on its inner surface. The piston 31 is provided with a fitting groove 57 into which the key 34 is fitted and which defines a communication hole 49' between the fitting groove 57 itself and the key 34.

With such construction, the need for a separate machine process for making a communication hole, such as the round hole 49 in the embodiment shown in FIGS. 1 to 7, is eliminated.

What is claimed is:

1. A screw type pump having a pair of screw rotors meshed with each other and rotatably supported in a housing, comprising a piston which is provided on a side of the housing having an intake port provided at one axial end for movement between a high-compression position inwardly in a moving direction perpendicular to an axis of the screw rotors and a low-compression position outwardly in the moving direction, said piston defining a discharge port in cooperation with a lead-out section provided at the other axial end of the housing, that portion of said piston which faces into the housing being formed so that a discharge starting position of the discharge port at the time when said piston is in said low-compression position is closer to the intake port than a discharge starting position of the discharge port at the time when said piston is in said high-compression position, and a back pressure chamber which a back of the piston faces, and a communication hole provided in the piston for permitting communication of the back pressure chamber with the discharge port.

2. A screw type pump according to claim 1, further including a back pressure chamber which a back of the piston faces, and a communication hole provided in the piston for permitting communication of the back pressure chamber with the discharge port.

3. A screw type pump according to claim 1, further including a drive member displaceable in said moving direction and biased by a spring outwardly in said moving direction, said drive member being connected to said piston, a control chamber which an outer portion of said drive member in said moving direction faces, and a switch over valve connected to said control chamber, said switch over valve selectively causing a discharge pressure from the discharge port and atmospheric pressure to be introduced into said control chamber in a switched manner for controlling movement of said piston by said drive member.

4. A screw type pump according to claim 1, further including a cylindrical guide portion provided in said housing and extending in a direction substantially perpendicular to axes of the screw rotors to loosely receive said piston, and a connecting member fixedly connected to the back of said piston and slidably carried in said housing, said connecting member being connected to a drive member for causing selective movement of said piston.

5. A screw type pump according to claim 1, wherein said piston is formed to have a circular cross section, a key secured to the housing and engaging the piston to inhibit rotation of the piston.

6. A screw type pump according to claim 3, further including a cylindrical guide portion provided in said housing and extending in a direction substantially perpendicular to axes of the screw rotors to loosely receive said piston, and a connecting member fixedly connected to the back of said piston and slidably carried in said housing, said connecting member connected to said drive member.

7. A screw type pump according to claim 4, wherein said piston and cylindrical guide portion are formed to have a circular cross section, said cylindrical guide portion having a key secured to an inner surface thereof to inhibit the rotation of the piston about its axis, said piston having a fitting groove into which said key is fitted, said communication hole being provided between said fitting groove and said key.

8. A screw type pump having a pair of parallel screw rotors meshed with each other and rotatably supported to extend axially in a generally cylindrical housing, comprising the housing having an intake port on one axial end and a lead-out discharge section at the other axial end, a piston provided on a side of said housing between said axial ends for movement between a high-compression inwardly located position in a moving direction perpendicular to the housing and a low-compression outwardly located position in the moving direction, said piston defining a discharge port in cooperation with a lead-out section provided at the other axial end of the housing, said piston having an inwardly facing portion shaped to closely fit outer extremes of the screw rotors to form a discharge starting position of the discharge port with said piston in said high-compression inward position which is further from intake port than a discharge starting position of the discharge port with said piston in said low-compression outward position spaced from the screw rotors, and a back pressure chamber in said housing on the outside of the piston, and a communication hole provided in the piston for permitting communication of the back pressure chamber with the discharge port.

9. A screw type pump according to claim 8, further including a back pressure chamber in said housing on the outside of the piston, and a communication hole provided in the piston for permitting communication of the back pressure chamber with the discharge port.

10. A screw type pump according to claim 8 further including a drive means in said housing for movement in said moving direction and biased outwardly by a spring, said drive means being connected to said piston, a control chamber defined in said housing on an outer side of said drive means, and a switchover valve connected to said control chamber for selectively causing either a discharge pressure from the discharge port or the atmospheric pressure to be introduced into said control chamber in a selectively switched manner for controlling movement of said piston by said drive means.

11. A screw type pump according to claim 8, further including a cylindrical guide portion provided in said housing and extending in a direction substantially perpendicular to axes of the screw rotors to loosely receive said piston, and a connecting member fixedly connected to back of said piston and slidably carried in said housing, said connecting member being connected to a drive means for selectively causing movement of said piston.

12. A screw type pump according to claim 11, wherein said piston and cylindrical guide portion are formed to have a circular cross section, said cylindrical guide portion having a key secured to an inner surface thereof to inhibit the rotation of the piston about its axis, said piston having a fitting groove into which said key is fitted, said communication hole being provided between said fitting groove and said key.

13. A screw type pump according to claim 10, wherein said drive means includes a diaphragm having a periphery sealingly mounted on the housing and a center portion connected to said piston for causing the piston movement.

14. A screw type pump according to claim 13, wherein said piston has a centrally located extension extending outwardly in the moving direction to which said diaphragm is connected, and said extension is slidably supported on the housing.

* * * * *